US006664494B2

(12) United States Patent
Kida et al.

(10) Patent No.: US 6,664,494 B2
(45) Date of Patent: Dec. 16, 2003

(54) CURRENT COLLECTOR AND GAS CIRCUIT BREAKER

(75) Inventors: Junzo Kida, Hitachi (JP); Makoto Hirose, Hitachi (JP); Tomoyuki Andou, Hitachi (JP)

(73) Assignee: Hitachi, Inc., Tokyo (JP)

( * ) Notice: Subject to any disclaimer, the term of this patent is extended or adjusted under 35 U.S.C. 154(b) by 0 days.

(21) Appl. No.: 10/253,932

(22) Filed: Sep. 25, 2002

(65) Prior Publication Data

US 2003/0173334 A1 Sep. 18, 2003

(30) Foreign Application Priority Data

Mar. 14, 2002 (JP) ..... 2002-069447

(51) Int. Cl.[7] ..... H01H 33/70
(52) U.S. Cl. ..... 218/45; 218/43; 218/48
(58) Field of Search ..... 218/76, 78, 84, 218/154, 45, 48, 49, 50, 65, 13, 16

(56) References Cited

U.S. PATENT DOCUMENTS 4,146,763 A * 3/1979 Handke ..... 218/48
4,181,837 A * 1/1980 Browne, Jr. ..... 218/48
4,393,291 A * 7/1983 Stewart et al. ..... 218/51
4,412,115 A * 10/1983 Okuno ..... 218/59
4,445,019 A * 4/1984 Gaupp et al. ..... 218/65
5,045,652 A * 9/1991 Yanabu et al. ..... 218/45
5,742,017 A * 4/1998 Perret ..... 218/143

* cited by examiner

*Primary Examiner*—Karl D. Easthom
*Assistant Examiner*—M. Fishman
(74) *Attorney, Agent, or Firm*—Mattingly, Stanger & Malur, P.C.

(57) ABSTRACT

A current collector, in which contact portions are free from dissolved loss even both fixed and moving contacts slidingly contact with each other, and durability as well as a current-carrying perfomance is improved, including a container, which is filled with an insulating arc-extinguishing medium and in which a cylindrical-shaped fixed contact and an torus-shaped contact disposed concentrically with the fixed contact and adapted to come into fitting contact with the fixed contact to carry current are received, and a torus-shaped current collecting member formed from a conductive material and provided on a contact portion of the torus-shaped contact.

9 Claims, 6 Drawing Sheets

CURRENT COLLECTOR AND GAS CIRCUIT BREAKER

BACKGROUND OF THE INVENTION

1. Field of the Invention

The invention relates to a current collector and a gas circuit breaker, and more particularly, to a current collector, in which moving and fixed contacts constituting a breaker for making an electric circuit ON and OFF come toward and away from each other to thereby carry and shut off current, and a gas circuit breaker.

2. Description of the Related Art

Typical of this type of gas circuit breaker is a puffer type gas circuit breaker. With this type of gas circuit breaker, an interrupting section is arranged in a metallic container filled with an arc-extinguishing gas such as $SF_6$ gas to be insulated electrically from the container, the arc-extinguishing gas is compressed in a compression device in relation to coming toward and away actions of contacts (current collector), which constitute the interrupting section, and the compressed gas is blown against an arc to extinguish.

An explanation will be given to conventional contacts (current collector) constituting an interrupting section of such puffer type gas circuit breaker.

FIGS. 5A, 5B and 6 show each a conventional current collector. In these figures, an outside fixed contact 14 formed from an electrically conductive member and an inside moving contact 13 are constructed to be concentrically cylindrical structure in a fitting contact relationship (the outside fixed contact 14 is cylindrically structured to be hollow and torus-shaped, and the inside moving contact 13 is cylindrically structured to be hollow or solid). Current flows, for example, to the inside moving contact 13 through a contact portion 15*a* from the outside fixed contact 14. The inside moving contact 13 is constituted so as to move on the outside fixed contact 14 with a circuit opening and closing operation of a circuit breaker so that a current-carrying contact portion slides. Formed on the fixed contact 14 are n slits, which extend therethrough radially, run a predetermined length in an axial direction, and partial fixed contacts $\mathbf{14}_1$, $\mathbf{14}_2$, - - - $\mathbf{14}_n$ constitute the fixed contact 14. Before the moving contact 13 and the fixed contact 14 fit together, the fixed contact 14 has an inside diameter $\phi D_1$ and an outside diameter $\phi D_3$ while the moving contact 13 has an outside diameter $\phi D_2$. Here, by virtue of $\phi D_1 > \phi D_2$, when the moving contact 13 and the fixed contact 14 fit together, an outside diameter of the fixed contact 14 becomes $\phi D_3, > \phi D_3$ so that the fixed contact 14 is flexed outward to give contact forces to the contact portion 15*a*.

However, with the above structure of a conventional current collector, as seen in FIG. 7 showing the detail of the contact portion 15*a* between the moving contact 13 and the fixed contact 14, inside and outside diameters of the moving contact 13 and the fixed contact 14 have the relationship of $\phi D_1 < \phi D_2$ and a processing problem is involved, so that the actual contact portion 15*a* forms the only part of circumferential end portions of the moving contact 13 and the fixed contact 14.

When the moving contact 13 and the fixed contact 14 slide in such contact (current-carrying) state, there is caused a problem that temperature rise is caused locally due to the high current density in the contact portion 15*a*, so that the members are decreased in hardness whereby the contact portion 15*a* undergoes excessive dissolved loss as compared with the case where the moving contact 13 and the fixed contact 14 do not slide relative to each other to decrease the durability of the current collector extremely.

SUMMARY OF THE INVENTION

The invention has been made in view of the above point, and has its object to provide a current collector or a gas circuit breaker, which is enhanced in durability as well as current-carrying performance without causing dissolved loss in a contact portion even when both moving and fixed contacts come into sliding contact with each other.

In order to attain the above object, the invention provides a current collector comprising a container, with an insulating arc-extinguishing medium being sealed therein, has a cylindrical-shaped fixed contact and an torus-shaped moving contact disposed concentrically with the fixed contact and adapted to come into fitting contact with the fixed contact to carry current stored therein, and a torus-shaped current collecting member formed from a conductive material is provided on a contact portion of either of the fixed contact and moving contact.

In order to attain the above object, the invention also provides a gas circuit breaker comprising a container with an insulating gas sealed therein, a fixed contact arranged in the container, a moving contact disposed facing the fixed contact in an opposed manner to be able to come toward and away from the fixed contact, a central shaft having a hollow portion and for making the moving contact movable by an operating force transmitted via an insulating rod from an operating device, a compression device provided outside of the central shaft for compressing a gas blown against an arc generated between the fixed contact and the moving contact, and an insulating nozzle for conducting to the arc the gas compressed by the compression device, wherein the fixed contact and the moving contact are connected together via a torus-shaped current collecting member to permit current to be carried.

DESCRIPTION OF THE PREFERRED EMBODIMENTS

Figure 12:
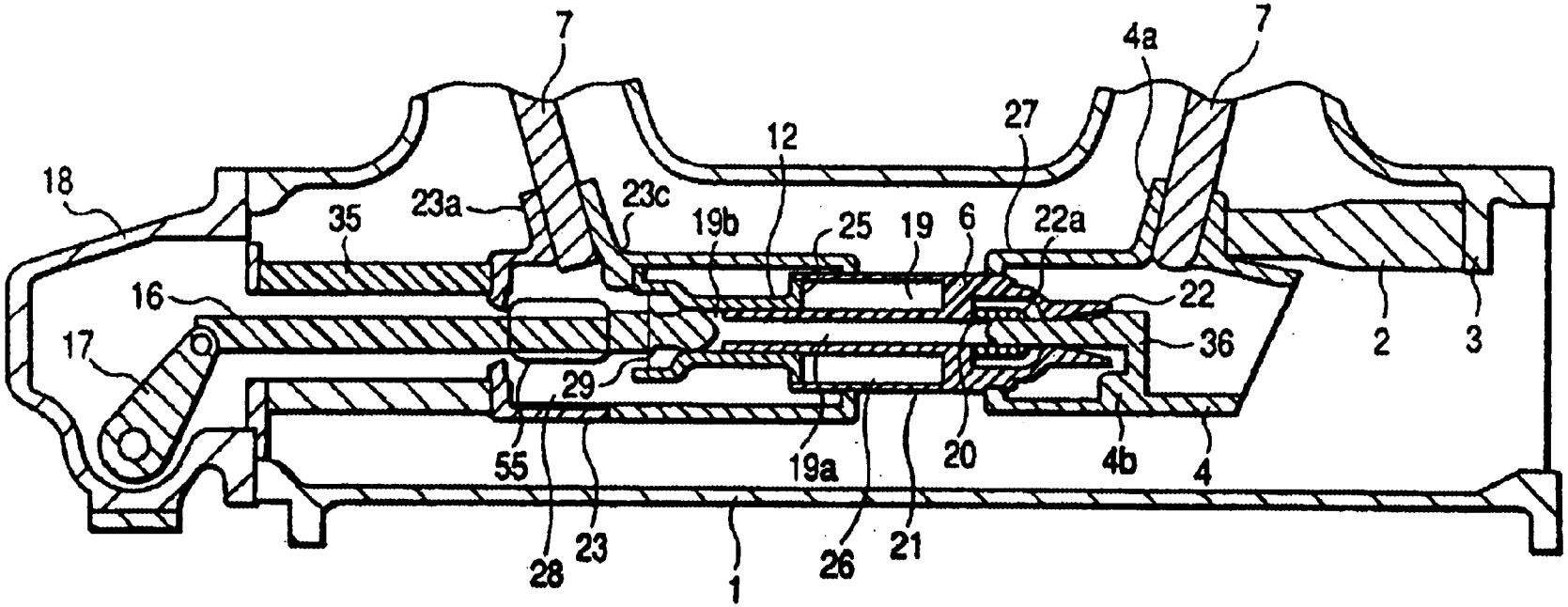
FIG. 12 is a cross sectional view showing an embodiment of a gas circuit breaker according to the invention.

An explanation will be given below to a current collector of the invention on the basis of the embodiments shown in the drawings. FIG. 12 is an example of a puffer type gas circuit breaker, in which the current collector of the invention is adopted.

In this figure, an opening/shutting mechanism section arranged in a metallic container 1 is composed of a fixed opening/shutting mechanism section provided on one side (right-side facing the figure) of the metallic container 1 with an insulating support 2 therebetween, and a moving opening/shutting mechanism section provided on the other side (left-side facing the figure) of the metallic container 1 with an insulating support 35 therebetween, the both opening/shutting mechanism sections being arranged facing each other in a direction along a central axis of the metallic container 1.

The insulating support 2 is fixed and supported by a support portion 3. A current-carrying member 4 connected to a central conductor 7 is fixed and supported on an opposite side of the support portion 3 of the insulating support 2.

The current-carrying member 4 is a cylindrical-shaped member having conductivity, which is provided at an upper portion thereof with a cylindrical-shaped conductor connecting portion 4*a*, projecting upward. A central conductor 7 is inserted into the conductor connecting portion 4*a* and also an end of the insulating support 2 on a side opposed to the support portion 3 is fixed on the conductor connecting portion 4*a*.

A fixed main-contact 27 is provided on a tip end of the current-carrying member 4 on a side opposed to the insulating support 2. The fixed main-contact 27 is a cylindrical-shaped contact electrode with a tip end thereof on the moving opening/shutting mechanism section side projecting radially inward. A support portion 4*b* projects radially inward from an inner peripheral surface of a lower portion of the current-carrying member 4, and a fixed arc contact 36 is fixed and supported on the support portion 4*b*. The fixed arc contact 36 is a rod-shaped contact electrode provided on a central axis of the metallic container 1 (or on a central axis of the fixed main-contact 27) to extend to a tip end of the fixed main-contact 27 from the support portion 4*b*.

An insulating support member 35 is cylindrical-shaped to be fixed and supported on the metallic container 1. An end cover 18 is provided on the other end of the metallic container 1. Arranged in the end cover 18 is a rotating shaft lever 17, which is connected to an operating rod (not shown) extending from an operating device (not shown) and to which an insulating rod 16 is connected. The insulating rod 16 is disposed on the central axis of the metallic container 1 to extend toward the fixed opening/shutting mechanism section through an interior of the insulating support member 35, and can be moved in a direction (horizontal direction) of the central axis of the metallic container 1 with an operating force of the operating device transmitted through the operating rod and the rotating shaft lever 17. A moving shaft 19 is provided on a tip end of the insulating rod 16 toward the fixed opening/shutting mechanism section. The moving shaft 19 is formed with a hollow portion 19*a*, which extends continuously in the direction along the central axis of the metallic container 1.

Provided on a tip end of the moving shaft 19 toward the fixed opening/shutting mechanism section is a moving arc contact 20 movable along the central axis of the metallic container 1 together with moving shaft 19. The moving arc contact 20 is a contact electrode structured to be able to come toward and away from the fixed arc contact 36 disposed facing each other in the direction along the central axis of the metallic container 1. That is, the moving shaft 19 moves toward the fixed opening/shutting mechanism section whereby an inner periphery of the moving arc contact 20 and an outer periphery of the fixed arc contact 36 come into sliding contact with each other, and the moving shaft 19 moves away from the fixed opening/shutting mechanism section toward the opposite side whereby the inner periphery of the moving arc contact 20 and the outer periphery of the fixed arc contact 36 come away from each other.

Provided on an outer periphery of the moving shaft 19 is a puffer cylinder 21, which is formed integrally with the moving shaft 19 and can move along the central axis of the metallic container 1 together with the moving shaft 19. The puffer cylinder 21 is a current-carrying member formed from a conductive member and structured to be double-cylindrical shape to be composed of an outer peripheral wall (called also an outer cylinder) and an inner peripheral wall (called also an inner cylinder). A moving main-contact 6 is provided on an outer peripheral surface of an end of the outer peripheral wall of the puffer cylinder 21 toward the fixed opening/shutting mechanism section. The moving main-contact 6 is a contact electrode structured to come toward and away from the fixed main-contact 27 arranged facing each other in the direction along the central axis of the metallic container 1. That is, the puffer cylinder 21 moves toward the fixed opening/shutting mechanism section together with the moving shaft 19 whereby an outer periphery of the moving main-contact 6 and an inner periphery of the fixed main-contact 27 come into sliding contact with each other, and the puffer cylinder 21 moves away from the fixed opening/shutting mechanism section together with the moving shaft 19 whereby the outer periphery of the moving main-contact 6 and the inner periphery of the fixed main-contact 27 are separated from each other.

An insulating nozzle 22 is provided on a tip end of the puffer cylinder 21 toward the fixed opening/shutting mechanism section in a manner to cover an outer periphery of the moving arc contact 20. The insulating nozzle 22 is a cylindrical-shaped member to cooperate with the outer periphery of the moving arc contact 20 to form a flow passage 22*a*, through which an insulating gas discharged from an interior of the puffer cylinder 21 is conducted toward a tip end of the moving arc contact 20.

A current-carrying member 23 connected to the central conductor 7 is fixed and supported on a tip end of the insulating support member 35 toward the fixed opening/shutting mechanism section. The current-carrying member 23 is a cylindrical-shaped conductive member provided on an upper portion thereof with an upward projecting conductor connection 23*a*, into which the central conductor 7 is inserted. A fixed contact 12 is provided on a tip end of the current-carrying member 23 toward the fixed opening/shutting mechanism section to come into contact with the moving main-contact 6.

A top of a tip end of a puffer piston 25 toward the insulating support member 35 is fixed and supported on a support 23*c* projecting radially inward from an inner periphery of the current-carrying member 23. The puffer piston 25 is a cylindrical-shaped member, which is disposed in the puffer cylinder 21 and is larger in radial thickness than the remaining portion thereof so that a tip end thereof toward the fixed opening/shutting mechanism section projects radially outward. The puffer piston 25 is formed to be larger in inner diameter on a side toward the insulating support member 35 than the remaining portion thereof.

The puffer cylinder 21 and the puffer piston 25 form a puffer chamber 26 on an outer periphery of the moving shaft 19. The puffer cylinder 21 is moved relative to the fixed puffer piston 25 to thereby cause the $SF_6$ gas as an insulating gas to be compressed in the puffer chamber 26. The insulating gas compressed in the puffer chamber 26 is discharged into the flow passage 22*a* via an exhaust hole (not shown), which is provided on a side of the puffer chamber 26 toward the insulating nozzle 22 to communicate the flow passage 22*a* to an interior of the puffer chamber 26, and blown against an arc generated between the fixed arc contact 36 and the moving arc contact 20 through the flow passage 22*a*.

An exhaust hood 28 defined by the current-carrying member 23 and the fixed contact 12 is provided rearwardly of the puffer chamber 26, that is, on a side of the insulating support member 35, so that a hot gas branching toward the moving side is discharged into the exhaust hood 28 via the hollow portion 19*a* of the moving shaft 19. Exhaust holes 19*b* for permitting a hot gas flowing through the hollow portion 19*a* to be discharged are provided on a side of the moving shaft 19 toward the insulating rod 16 and formed at two circumferential locations facing each other vertically relative to a horizontal plane to permit the hot gas to be discharged toward the moving opening/shutting mechanism section from the fixed opening/shutting mechanism section.

Figure 1A:
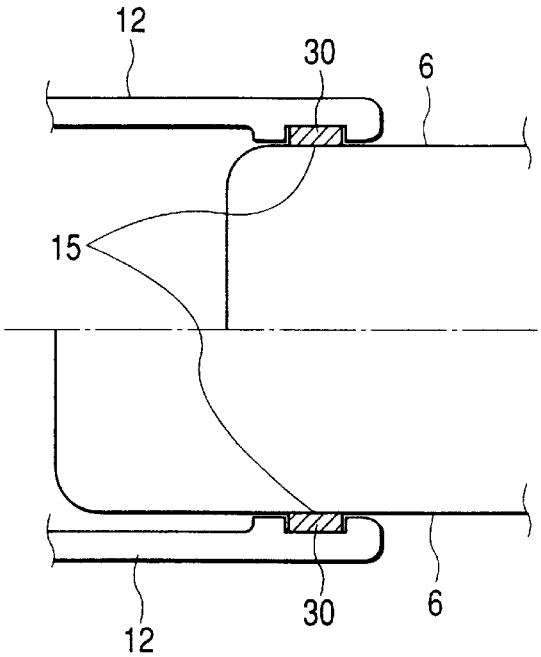
FIGS. 1A and 1B show an embodiment of a current collector, FIG. 1A being a cross sectional view, and FIG. 1B being a transverse cross sectional view.
Figure 1B:
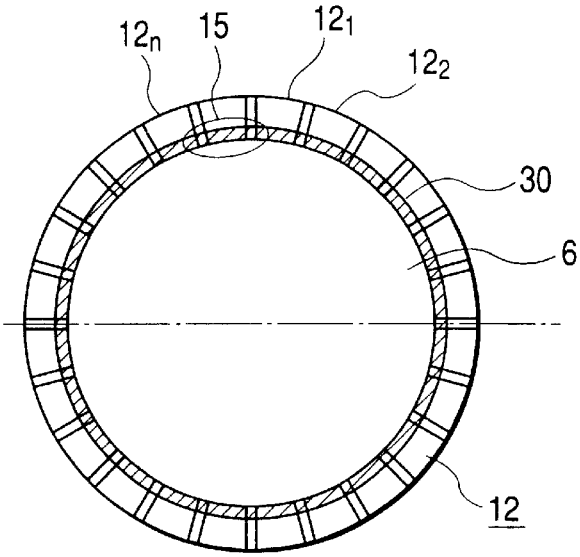

The current collector according to the embodiment comprises, as shown in FIGS. 1A and 1B, a torus-shaped current collecting member 30, which is provided on the fixed contact 12 at a contact portion of the outside fixed contact 12 and the inside moving main-contact 6 and formed from a conductive material (for example, chromium-copper and brass having a spring quality, lightweight aluminum, cylindrical-shaped copper, copper and chromium-copper having a good conductivity). Formed on the torus-shaped fixed contact 12 are n slits, which extend therethrough radially as shown in FIG. 1B and run a predetermined length in an axial direction, and a plurality of partial fixed contacts $\mathbf{12}_1$, $\mathbf{12}_2$, - - - $\mathbf{12}_n$ constitute the fixed contact. A torus-shaped groove (recess) is provided partially on contact surfaces of the partial fixed contacts $\mathbf{12}_1$, $\mathbf{12}_2$, - - - $\mathbf{12}_n$ and the above current collecting member 30 is fitted into the groove (recess). Current, for example, flows from the fixed contact 12 to the moving main-contact 6 via the current collecting member 30.

In this manner, with the current collector according to the embodiment, the outside fixed contact 12 and the inside moving main-contact 6, which are concentric and cylindrical-shaped, are constructed in a fitting manner and electrically connected to each other via the current collecting member 30 to carry current.

Figure 2:
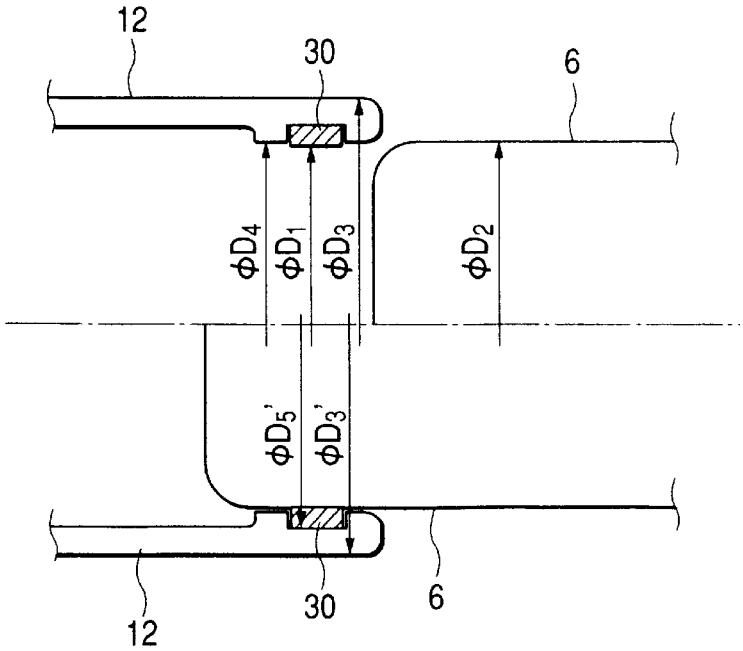
FIG. 2 is a view showing the dimensional relationship between a moving contact and a fixed contact before and after insertion.

The schematic, dimensional relationship among the moving main-contact 6, fixed contact 12 and the current collecting member 30 is shown in FIG. 2.

As described above, the current collecting member 30 is fitted into the groove (recess) formed inside the fixed contact 12. Before the moving main-contact 6 having an outside diameter $\phi D_2$ is inserted into the fixed contact 12, to which the current collecting member 30 has been mounted, an inside diameter of the current collecting member 30 is $\phi D_1$, and inside and outside diameters of the fixed contact 12 are $\phi D_4$ and $\phi D_3$, respectively. Here, by virtue of $\phi D_1 < \phi D_2$, when the moving main-contact 6 is inserted into the fixed contact 12 and the moving main-contact 6 and the current collecting member 30 fit together, the relationship between the outside diameter $\phi D_3$ before fitting and the outside diameter $\phi D_3$, after fitting, of the fixed contact 12 becomes $\phi D_3, > \phi D_3$, and thus flexing of the current collecting member 30 gives a contact force to the contact portion 15*a*.

Figure 3A:
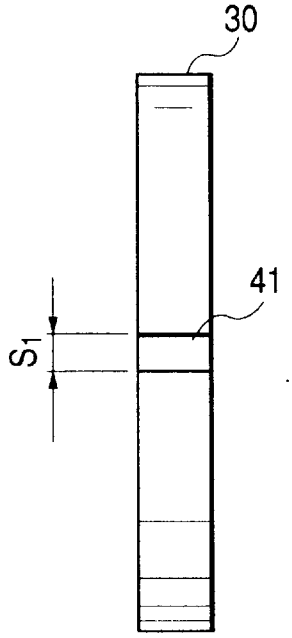
FIGS. 3A and 3B show an example of a current collecting member adopted in the invention, FIG. 3A being a side view and FIG. 3B being a front view.
Figure 3B:
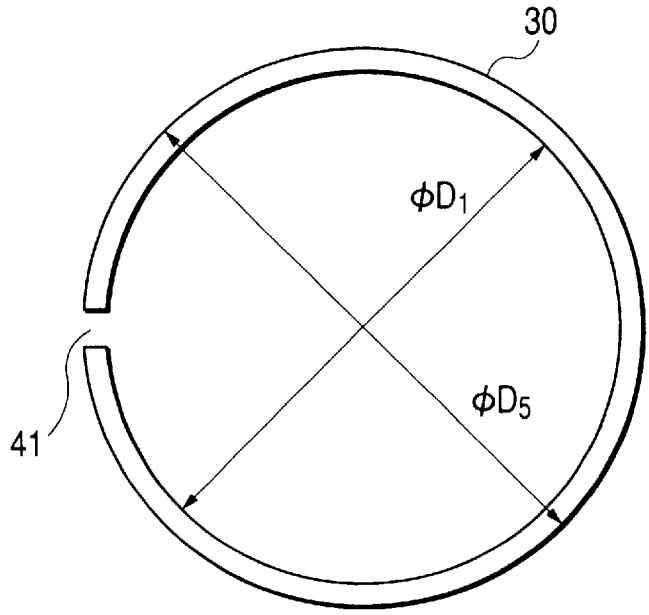
Figure 4A:
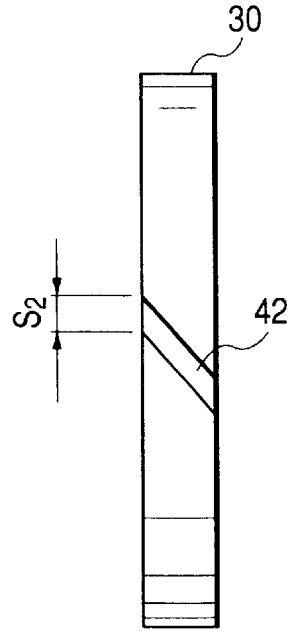
FIGS. 4A and 4B show a not her example of a current collecting member adopted in the invention, FIG. 4A being a side view and FIG. 4B being a front view.
Figure 4B:
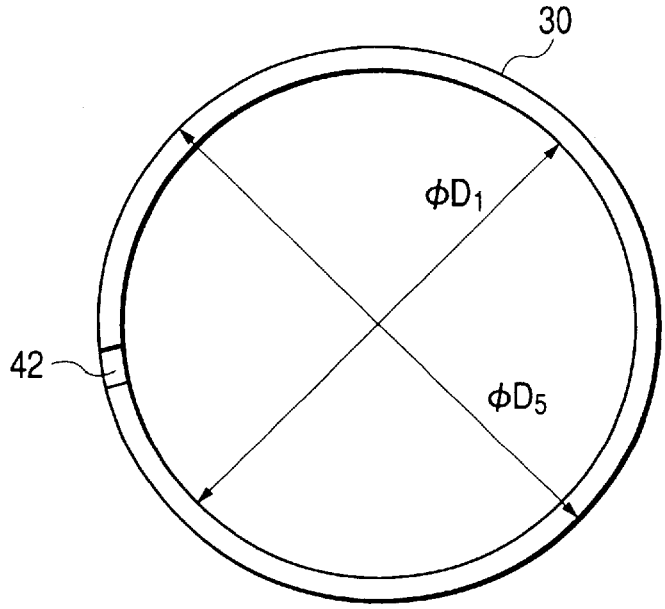
Figure 5A:
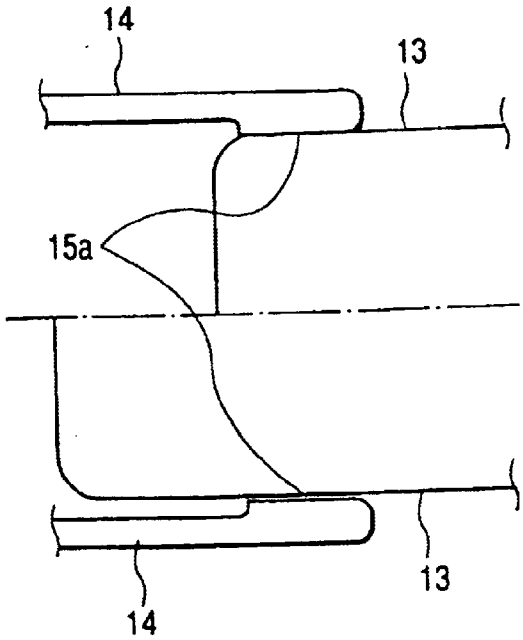
PRIOR ART FIG. 5(a)
FIGS. 5A and 5B show an example of a conventional current collector, FIG. 5A being a cross sectional view, and FIG. 5B being a transverse cross sectional view.
Figure 5B:
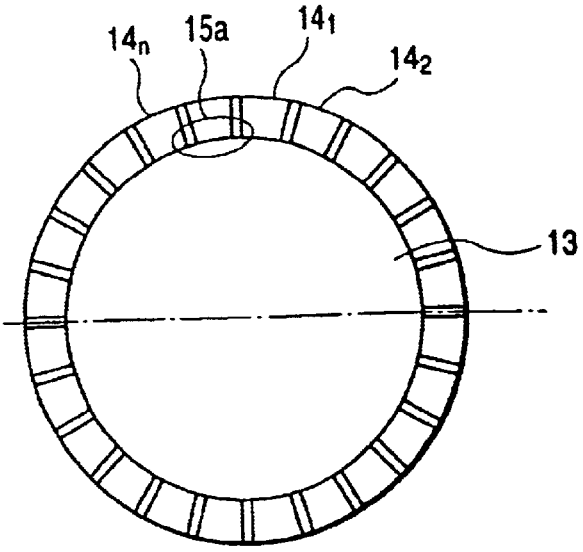
PRIOR ART FIG. 5(b)
Figure 6:
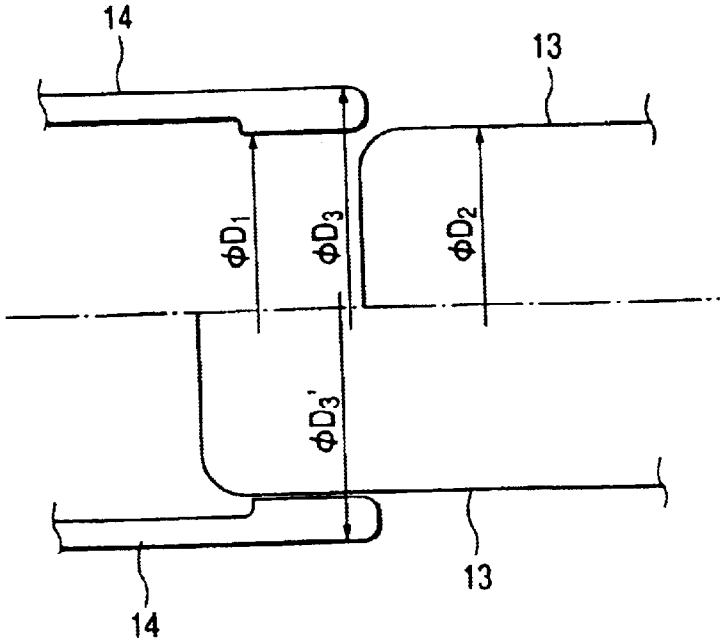
PRIOR ART FIG. 6
FIG. 6 is a view showing the dimensional relationship between a moving contact and a fixed contact before and after insertion in FIG. 5A.

FIGS. 3A, 3B and FIGS. 4A, 4B show the current collecting member 30 in detail. As described above, the current collecting member 30 is composed of a torus-shaped conductive material and partially formed with a notch 41 as shown in FIGS. 3A, 3B or a notch 42 as shown in FIGS. 4A, 4B, and has an outside diameter $\phi D_5$ and an inside diameter $\phi D_1$. In the example shown in FIGS. 3A, 3B, the notch 41 having a width $S_1$, is provided in the current collecting member 30 to be in parallel to a central axis of the torus, and a difference in diameter between $\phi D_1$ and $\phi D_2$ is accommodated by inserting and withdrawing the moving main-contact 6 within or from the fixed contact 12, to which the current collecting member 30 has been mounted. In the example shown in FIGS. 4A, 4B, the notch 42 having a width $S_2$ is provided obliquely, and a difference in diameter can be accommodated in the same manner as in FIGS. 3A, 3B. In addition, although not shown, it goes without saying that a similar effect to the above can be obtained in the case where a plurality of notches are provided in the current collecting member 30.

Figure 8:
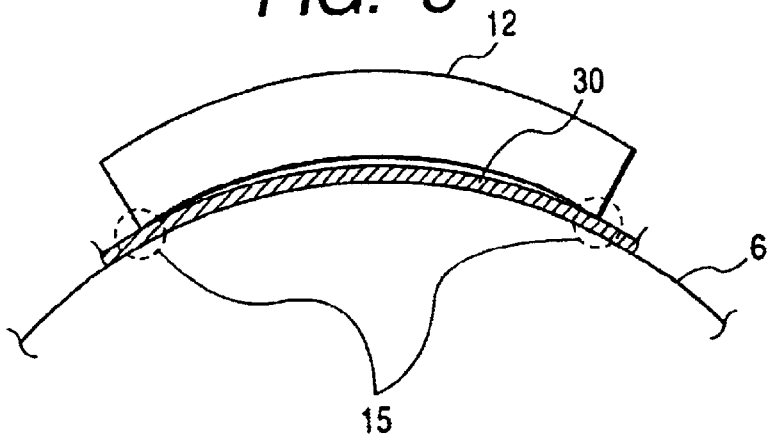
FIG. 8 is a view showing a state, in which a moving contact and a fixed contact in an embodiment of the invention contact with each other.

FIG. 8 shows in detail the contact portion 15 of the current collector shown in FIG. 1. In the related art, contact on actual sliding surfaces occurs partially on a circumference of the contacts due to a difference between outside and inside diameters of the moving contact 13 and the fixed contact 14.

In contrast, with the embodiment, the fixed contact 12 and the moving main-contact 6 interpose therebetween the current collecting member 30 to hold the same, so that an inner periphery of the current collecting member 30 follows and contacts the outer periphery of the moving main-contact 6. As a result, the non-sliding contact between the current collecting member 30 and the fixed contact 12 occupies a part of a circumference but the sliding contact between the current collecting member 30 and the moving main-contact 6 occupies an entire circumference.

Figure 7:
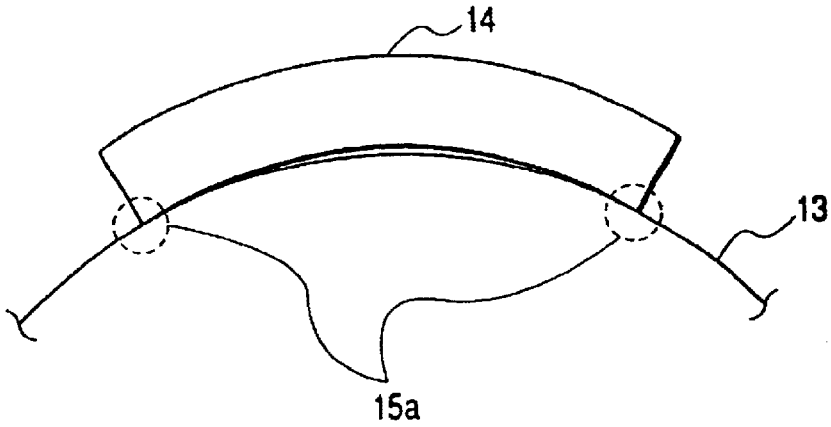
PRIOR ART FIG. 7
FIG. 7 is a view showing a state, in which a moving contact and a fixed contact in the prior art contact with each other.

It is commonly known that in the case of sliding as compared with the case of non-sliding, a current-carrying performance is extremely degraded to undergo dissolved loss in the contact portion. In order to solve this problem, it is effective to decrease a current density of a current-carrying portion to suppress local temperature rise in a contact portion. In the embodiment, a contact area of the sliding contact portion is greatly enlarged to enable to decrease current density as seen from the comparison between FIG. 7 and FIG. 8, so that even when both current-carrying and sliding are performed simultaneously in a current collector, dissolved loss can be prevented from generating in the sliding portion. As a result, it becomes possible to improve the current-carrying performance and durability of a current collector to extend the service life thereof and enhance reliability thereof, and further to increase the current-carrying capacity for achievement of a large capacity in a current collector.

Figure 9:
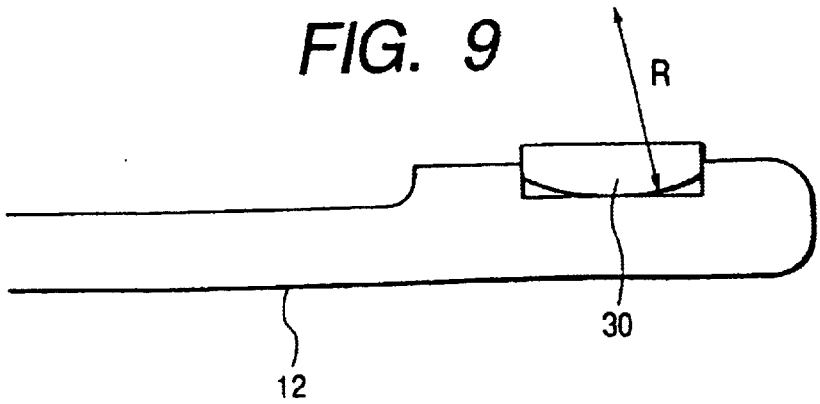
FIG. 9 is a cross sectional view showing another embodiment of a current collector according to the invention.
Figure 10:
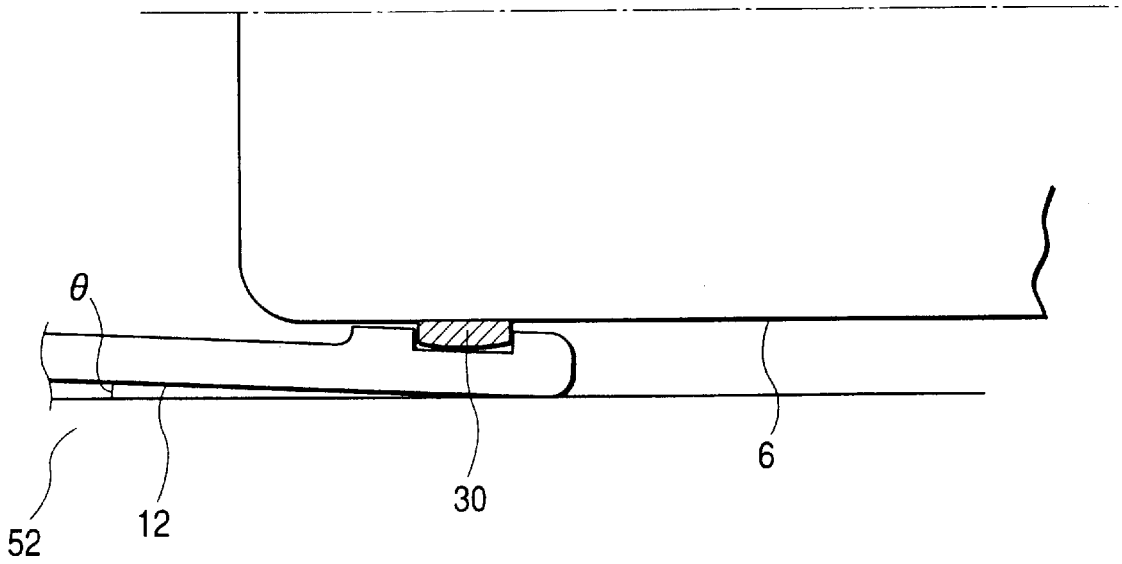
FIG. 10 is a view showing a state, in which the moving contact and the fixed contact in the embodiment of the invention shown in FIG. 9 contact with each other.

FIGS. 9 and 10 show another embodiment of the invention.

With the embodiment shown, the contact portion of a current collecting member 30 and the fixed contact 12, is formed to have a circular-shaped cross section having a curvature R. FIG. 10 shows a state, in which the moving main-contact 6 is stored in the case where the current collecting member 30 shown in FIG. 9 is used.

According to this embodiment, the fixed contact 12 is pressed by the moving main-contact 6, with a moving main-contact 6 stored in the fixed contact 12, and the fixed contact 12 is in some cases distorted at an angle θ relative to a horizontal direction, so that the current collecting member 30 formed to be rectangular parallelopiped in cross section is decreased in an area where it contacts with the moving main-contact 6. However, since that portion of a current collecting member 30, which contacts with the fixed contact 12, is formed to have a circular-shaped cross section having a curvature R, the circular shape accommodates distortion of the fixed contact 12 to materialize enlargement of an area where the current collecting member 30 contacts with the moving main-contact 6, and further there comes out a state, in which the fixed contact 12 and the current collecting member 30 contact stably with each other even when the fixed contact 12 is distorted.

Figure 11:
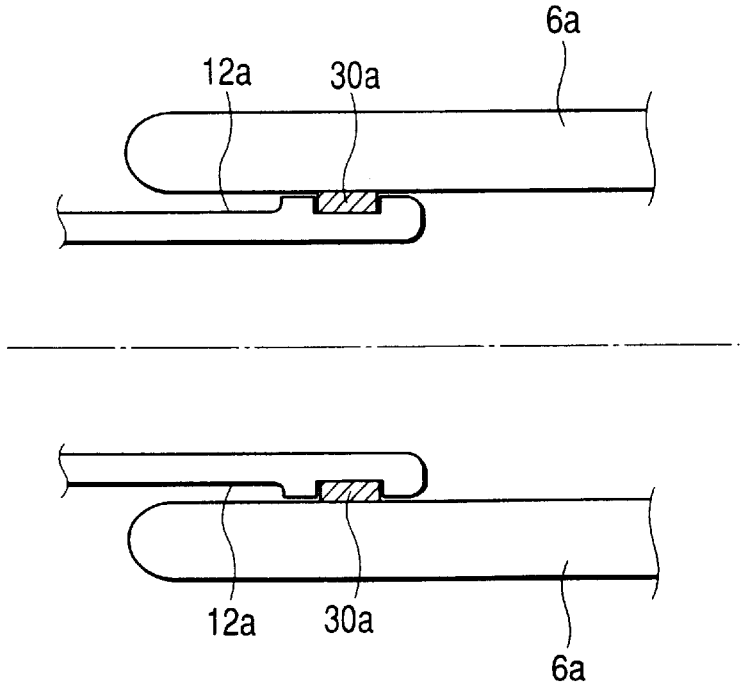
FIG. 11 is a view showing another embodiment of a current collector according to the invention corresponding to FIG. 1A.

FIG. 11 shows a further embodiment of the invention. The construction in the embodiment shown is such that a fixed contact 12*a* is fitted into a moving main-contact 6*a*, a current collecting member 30*a* is provided on an outer periphery of the fixed contact 12*a*, and the outer periphery of the fixed contact 12*a*, on which the current collecting member 30*a* is present, and an inner periphery of the moving main-contact 6*a* slidingly contact with each other to enable carrying current between the both. Such construction is the same in effect as that in the above-mentioned embodiments.

In addition, while an explanation has been given to the case where a current collecting member is provided on an inner periphery or outer periphery of a fixed contact, it goes without saying that the current collecting member may be provided on an inner periphery or outer periphery of a moving contact. Also, while a current collecting member is provided on a moving contact or a fixed contact, the same effect is obtained in the case where it is provided on the current collecting member, which is not accompanied by the opening and closing action of the moving contact but only slides.

According to the invention described above, contact portions are free from dissolved loss even in an arrangement, in which both fixed and moving contacts slidingly contact with each other, and so there is obtained an effect that durability as well as the current-carrying performance is improved.

What is claimed is:

1. A current collector comprising a container with an insulating arc-extinguishing medium sealed therein, having a cylindrical-shaped fixed contact and a torus-shaped moving contact disposed concentrically with the fixed contact and adapted to come into fitting contact with the fixed contact to carry current stored therein, and a torus-shaped current collecting member formed from a conductive material provided on a contact portion of one of the fixed contact and moving contact, wherein the fixed contact is provided on a tip end of a current-carrying member connected to a central conductor and the moving contact is provided on an outer peripheral surface of an end of a puffer cylinder.

2. A current collector comprising a container with an insulating arc-extinguishing medium sealed therein, having a cylindrical-shaped moving contact and a torus-shaped fixed contact disposed concentrically with the moving contact and adapted to come into fitting contact with the moving contact to carry current stored therein, and a torus-shaped current collecting member formed from a conductive material provided on a contact portion of the fixed contact, wherein the fixed contact is provided on a tip end of a current-carrying member connected to a central conductor, and the moving contact is provided on an inner peripheral surface of an end of a puffer cylinder.

3. The current collector according to claim 1, wherein the torus-shaped current collecting member includes a torus-shaped conductive material having partially a notch formed therein.

4. The current collector according to claim 2, wherein the torus-shaped moving contact is formed with slits, which extend radially through the contact and axially, and a torus-shaped recess is provided on an inside of the torus-shaped contact to have the torus-shaped current collecting member fitted therein.

5. The current collector according to claim 4, wherein the portion of the current collecting member which contacts with the recess of the fixed contact has a circular-shaped contact surface.

6. The current collector according to claim 1, wherein the current collecting member is formed mainly from any one of copper, chromium-copper, brass, aluminum, and aluminum alloy.

7. A gas circuit breaker comprising a container filled with an insulating gas, a first fixed contact arranged in the container, a first moving contact disposed facing the first fixed contact to be able to come toward and away from the first fixed contact, a central shaft having a hollow portion and for making the first moving contact movable by an operating force transmitted via an insulating rod from an operating device, a compression device provided outside of the central shaft for compressing a gas blown against an arc generated between the first fixed contact and the fist moving contact, an insulating nozzle for conducting to the arc the gas compressed by the compression device, and a cylindrical-shaped second fixed contact is provided on a tip end of a current-carrying member connected to a central conductor, and a torus-shaped second moving contact is provided on an inner peripheral surface of an end of a puffer cylinder, wherein the second fixed contact and the second moving contact are electrically connected together via a torus-shaped current collecting member to permit current to be carried.

8. A gas circuit breaker comprising a container filled with an insulating gas, a first fixed contact arranged in the container, a first moving contact disposed facing the first fixed contact to be able to come toward and away from the first fixed contact, a central shaft having a hollow portion and for making the first moving contact movable by an operating force transmitted via an insulating rod from an operating device, a compression device provided outside of the central shaft for compressing a gas blown against an arc generated between the first fixed contact and the first moving contact, an insulating nozzle for conducting to the arc the gas compressed by the compression device, and a cylindrical-shaped second fixed contact is provided on a tip end of a current-carrying member connected to a central conductor, a torus-shaped second moving contact is provided on an inner peripheral surface of an end of a puffer cylinder and a torus-shaped current collecting member provided on one of the second fixed contact and the second moving contact and formed from a conductive material.

9. A gas circuit breaker comprising a container filled with an insulating gas, a first fixed contact arranged in the container, a first moving contact disposed facing the first fixed contact to be able to come toward and away from the first fixed contact, a central shaft having a hollow portion and for making the first moving contact movable by an operating force transmitted via an insulating rod from an operating device, a compression device provided outside of the central shaft for compressing a gas blown against an arc generated between the first fixed contact and the first moving contact, an insulating nozzle for conducting to the arc the gas compressed by the compression device, a cylindrical-shaped second fixed contact is provided on a tip end of a current-carrying member connected to a central conductor, a torus-shaped second moving contact is provided on an inner peripheral surface of an end of a puffer cylinder and a torus-shaped current collecting member provided on a contact portion of the second fixed contact and formed from a conductive material.

* * * * *